US005957558A

United States Patent [19]

Quade

[11] Patent Number: 5,957,558

[45] Date of Patent: Sep. 28, 1999

[54] COMBINATION DRAWER/SHELF STORAGE UNIT

[76] Inventor: Robert C. Quade, 2025 Miller Ct., Lakewood, Colo. 80215

[21] Appl. No.: 08/898,810

[22] Filed: Jul. 23, 1997

[51] Int. Cl.[6] ..... A47B 88/00

[52] U.S. Cl. ..... 312/323; 312/246; 312/334.19

[58] Field of Search ..... 312/245, 246, 312/322, 323, 334.18, 334.19, 334.12, 334.21, 334.45, 334.46

[56] References Cited

U.S. PATENT DOCUMENTS

| | | | |
|---|---|---|---|
| 348,015 | 8/1886 | Hoffman | 312/323 |
| 1,330,301 | 2/1920 | Brown . | |
| 1,916,397 | 7/1933 | Unger . | |
| 2,274,263 | 2/1942 | Bescherer . | |
| 2,749,201 | 6/1956 | Koury et al. . | |
| 2,839,349 | 6/1958 | Culver . | |
| 2,898,159 | 8/1959 | Arnit | 312/334.19 X |
| 3,113,819 | 12/1963 | Wright . | |
| 3,716,284 | 2/1973 | Vogt | 312/334.19 X |
| 4,065,196 | 12/1977 | Stein | 312/334.19 X |
| 4,160,571 | 7/1979 | Bigotti | 312/322 X |
| 5,201,575 | 4/1993 | Stolzel | 312/323 |
| 5,215,364 | 6/1993 | Moore | 312/323 |
| 5,242,219 | 9/1993 | Tomaka | 312/245 |
| 5,244,272 | 9/1993 | Thompson . | |
| 5,348,207 | 9/1994 | Frank . | |
| 5,385,399 | 1/1995 | Weidner | 312/323 X |
| 5,507,571 | 4/1996 | Hoffman | 312/334.46 X |
| 5,772,295 | 6/1998 | Sundmark | 312/245 X |

FOREIGN PATENT DOCUMENTS

| | | | |
|---|---|---|---|
| 181398 | 3/1955 | Austria | 312/323 |
| 536114 | 3/1955 | Belgium | 312/323 |
| 1219879 | 5/1960 | France | 312/323 |

*Primary Examiner*—Jose V. Chen
*Assistant Examiner*—Hanh V. Tran
*Attorney, Agent, or Firm*—Timothy J. Martin; Michael R. Henson

[57] ABSTRACT

A storage unit includes frame pieces that attach to a support structure. A first rail assembly has first rails disposed on the frame pieces so that facing channels define a storage region. A drawer is positioned in the storage region when in a stored state. A second rail assembly includes second rails each having a second channel. The second channels receive first wheels that are on the first rail assembly while the first channels receive second wheels that are disposed on the second rail assembly. The drawer may be advanced out of the stored state to an extended state and then into a pivoted state wherein it is perpendicular to the stored state. The rails may be immovably fixed to the frame pieces and the drawer, respectively. The drawer may be mounted underneath the support structure. Arcuate guide fingers guide the engagement and disengagement of the first wheels from the second channels when the drawer is moved between the extended and pivoted states. A limit stop is used to stop the drawer motion at the extended state when moved from the stored state. The drawer may be provided with retaining bars to retain items therein whether the drawer is in the stored or pivoted states.

16 Claims, 4 Drawing Sheets

COMBINATION DRAWER/SHELF STORAGE UNIT

FIELD OF THE INVENTION

The present invention generally relates to storage apparatus for various objects. More particularly, the present invention concerns storage unit wherein concerns a drawer receives items in a stored state yet which drawer is movable and repositionable to define a shelf for accessing the items. The present invention is specifically directed to a combination spice shelf and drawer for kitchen use.

BACKGROUND OF THE INVENTION

Throughout the home, a need exists to store a large variety of different items. This naturally results from the vast array of things that have been developed to increase the comfort level of living. The amassing of the various objects used in day-to-day endeavors, however, gives rise to a need for adequate storage of those items when not in use yet which storage facilities nonetheless provide quick and convenient access to items when their use is desired.

Perhaps one of the more challenging areas in the human home that requires storage of a vast array of items is the kitchen. In the kitchen environment, food is mixed, heated, stored, etc., in and by a wide variety of different utensils. For dining, the kitchen is often the area where plates, cups, glasses, silverware and the like are stored, used and cleaned. Thus, the collection of such objects requires substantial storage facilities such as drawers, cupboards and countertops.

Since many persons enjoy the consumption of flavorable food entrees and side dishes, the food preparer often employs a wide variety of herbs, seasonings and spices. Since food preparation takes place in the kitchen area, it is typical to store these condiments nearby for convenience of use. Often, the individual containers for spices, seasonings and the like are in the form of small bottles or cans. It is not unusual for the food preparer to have a large number of such spices, and seasonings; the storage of the containers for the same presents a problem of organization. On one hand, due to the large number of the containers, substantial storage space is required. Due to the size of the containers, moreover, it is easy for the storage space to get disorganized, especially where the food preparer must search through a plurality of containers to find the desired spices or seasonings.

For this reason, various "spice racks" have been developed to receive individual containers in a more organized format. These spice racks are typically in the form of a shelf having shelves and retainers of a size designed to meet the small size of containers in which the seasonings are stored. Free standing spice racks, however, usually require their own independent mounting on a vertical wall surface. Many kitchens, due to their size, do not provide sufficient wall space to accommodate these spice racks. Where smaller spice racks are mounted on cupboard doors, for example, they typically do not provide sufficient storage space for a wide variety of containers.

The need to provide space saving storage for spice containers has been recognized in the past. For example, in U.S. Pat. No. 5,244,272 issued Sep. 14, 1993 to Thompson, an under cabinet spice jar drawer is shown which includes an installation plate that is adapted to secure the underside of a cabinet. A pair of facing guide rails or channels receive oppositely projecting flanges on the sides of a drawer. The drawer has transverse, semi-circular channels sized to receive spice containers. When the drawer is removed from a stored position to an extended position, it may tilt downwardly to make the spice containers more accessible.

Notwithstanding the benefits of the drawer shown in the '272 Patent, however, there remains a need for improved storage units especially adapted for the containers of the spices and other seasonings. There is a need for such storage units that have increased storage capacity. Thus, there is a need for a sturdy storage unit construction which mounts easily to a support surface which unit provides ready and organized access to an ensemble of spice and/or seasoning containers.

SUMMARY OF THE INVENTION

It is an object of the present invention to provide a new and useful storage unit that is adapted to mount to a support structure and receive a plurality of individually contained items for selected storage and retrieval.

It is another object of the present invention to provide a combination storage drawer and shelf which can be oriented vertically to display an ensemble of spice or seasoning containers for use yet which can be stored in a horizontal position in and out of the way location.

Yet another object of the present invention is to provide a combination storage drawer and shelf for individual items which includes guides to assist supported movement between two orthogonal orientations.

Still a further object of the present invention is to provide a storage unit for spice and seasoning containers which provides a relatively large storage region in a sturdy structure.

It is still a further object of the present invention to provide a storage unit, especially adapted for individual spice containers, which is relatively inexpensive yet easy to install and use.

According to the present invention, then, a storage unit is provided and is adapted to mount to a support structure. This storage unit is especially configured to receive individual items, such as spice and seasoning containers, in an organized manner for selected storage and retrieval.

Broadly, the storage unit of the present invention has a first rail assembly that includes a pair of first rails that are disposed on the support structure in spaced apart, opposed relation to one another so as to define a storage region therebetween. Each of these first rails have first channels with the first channels facing one another. This first rail assembly also includes a first wheel that is rotatably supported on each first rail and a first limit stop disposed on each first rail. A drawer is sized and adapted to be positioned in the storage region between the first rail to define a stored state when the drawer has a stored orientation, typically horizontal. A second rail assembly is provided and includes a pair of second rails that are disposed on opposite side portions of the drawer. A second wheel is rotatably supported on each of the second rails, and each of the second rails has a second channel facing a respective first channel when the drawer is in the stored state. Each of the first wheels are then received in a respective one of the second channels and each of the second wheels is received in a respective one of the first channels. Thus, the drawer is movable from the stored state to an extended state wherein the drawer is advanced out of the storage region to a location wherein the second wheels each abut a respective first limit stop. When the drawer is in the extended state, it is pivotable on the second wheels to move into a pivoted state when the drawer is in a perpendicular orientation with respect to the stored orientation with each of the first wheels becoming disengaged from a respective second channel. Thus, the drawer becomes, in essence, a vertical shelf.

Preferably, the drawer has a bottom wall, a pair of spaced apart opposed end walls and first and second spaced apart opposed sidewalls extending between the end walls to define an interior for the drawer. An interior wall is located between the sidewalls and extends between the end walls thereby dividing the interior into first and second compartments. First and second retaining bars extend between the end walls in spaced relation to the bottom wall and to the interior wall on either side thereof. The first rail assembly is preferably received in a frame or housing that is then mounted to the underside of a cabinet so that the drawer is horizontal. The frame has a pair of spaced apart opposed frame end walls, a frame back wall and a frame upper wall that forms a storage region. Here, the first rails of the first rail assembly are mounted on the interior side of each of the frame end walls in parallel spaced apart opposed relation to one another. When the drawer pivots into the vertical position that is orthogonal to the horizontal orientation of the drawer, the containers received within the drawer rest on the drawer front wall and on the interior wall which acts as shelves, thus displaying the containers for reference and access. The retaining bars act, when the drawer is in the vertical orientation, to prevent inadvertent dislodgment of the items received therein.

An arcuate finger may be disposed on each of the second rails, with each guide finger positioned to guide engagement and disengagement a respective first wheel and second channel when the drawer is pivoted with respect to the first rails. A second limit stop may be provided on each of the second rails opposite the first limit stop so that the second wheels each abut a respective second limit stop when the drawer is moved into the stored orientation. The first limit stops may be formed of stiff yet resilient elements to cushion impact of the second wheels thereof. The first limit stops may be removable to permit disengagement of the first and second rails and permit removal of the drawer from its supports.

If desired, the first limit stop encloses a respective end of a respective first channel thereby to prevent a respective one of the second wheels from disengagement therewith. Thus, the drawer is nonremovably secured by the first and second rail assemblies. However, the first limit stops are each preferred to be selectively removable, in such case, such that each of the first wheels becomes disengageable from its respective channel thereby to permit removal of the drawer from the support structure.

In one embodiment, each of the first rails is mounted in a stationary or immovable relationship with respective to the support structure. Alternatively, a pair of third rails may be mounted in a stationary relationship to the support structure with each of the third rails slidably mounting a respective one of the first rails so that each first rail is movable with respect to the support structure. Thus, an additional throw distance is provided for the rail assemblies so that the drawer may be mounted interiorly of a cabinet yet project sufficiently therefrom in the extended state so as to clear the cabinet base during use. In any event, a pivot limit stop may be provided to prevent angularly movement of the drawer beyond the perpendicular orientation and to support a bottom wall portion of the drawer when the drawer is in the pivoted state.

These and other objects of the present invention will become more readily appreciated and understood from a consideration of the following detailed description of the exemplary embodiments when taken together with the accompanying drawings, in which:

BRIEF DESCRIPTION OF THE DRAWINGS

FIG. 7(*b*) is a diagrammatic side view in elevation showing the storage unit of the present invention secured to a support structure and in the extended position;

FIG. 7(*c*) is a diagrammatic side view in elevation showing the storage unit of the present invention secured to a support structure and in the pivoted position;

DETAILED DESCRIPTION OF THE EXEMPLARY EMBODIMENT

The present invention is directed to a storage unit that is adapted to mount to a support structure and that is operative to receive a plurality of items for selected storage and retrieval. Specifically, the storage unit of the present invention is designed to receive small jars, cans or other containers, especially of spices, condiments and seasonings, for use in a kitchen. Thus, the storage unit of the present is adapted to mount to a support structure, especially, the underside or inside of a kitchen cabinet. Accordingly, the present invention is described with these exemplary embodiments in mind, but it should be understood that the storage unit of the present invention is not to be limited to these particular applications.

Figure 1:
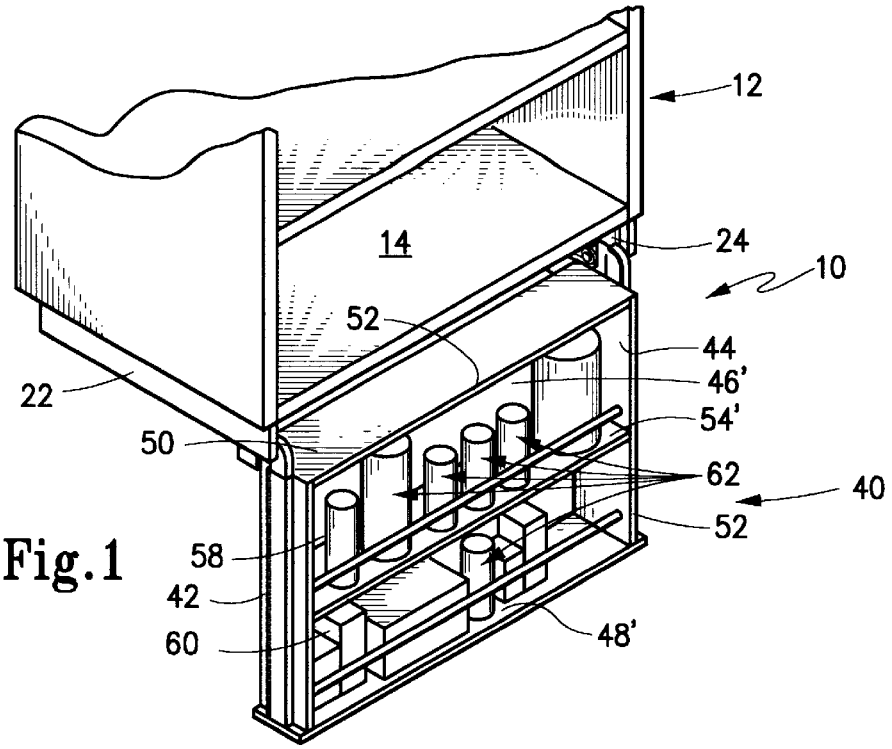
FIG. 1 is a perspective view of a storage unit according to a first exemplary embodiment of the present invention shown attached to the underside of a support structure in the form of a kitchen cabinet.

Turning then to FIGS. 1–5, it may be seen that storage unit 10 is adapted to mount to a support structure such as a base wall 14 of a kitchen cabinet 12. As is shown in FIG. 1, it is preferred to mount storage unit 10 to the underside of cabinet 12, although alternative mounting constructions are possible.

Figure 2:
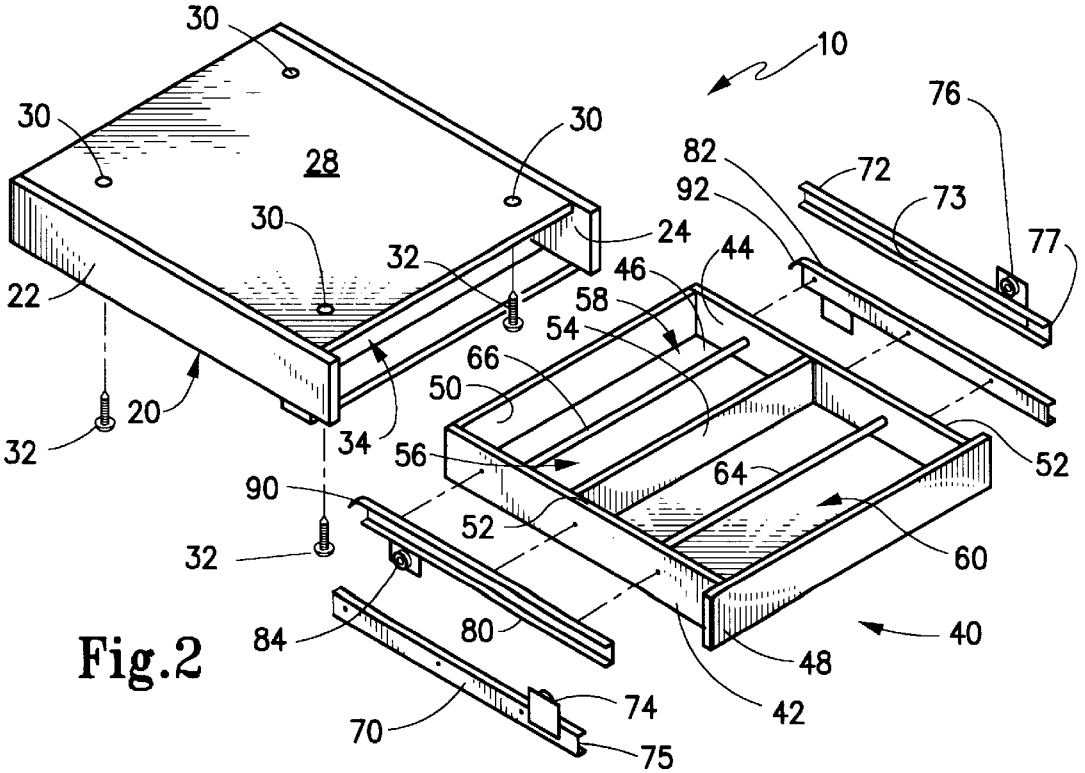
FIG. 2 is an exploded perspective view of the storage unit of FIG. 1.
Figure 3:
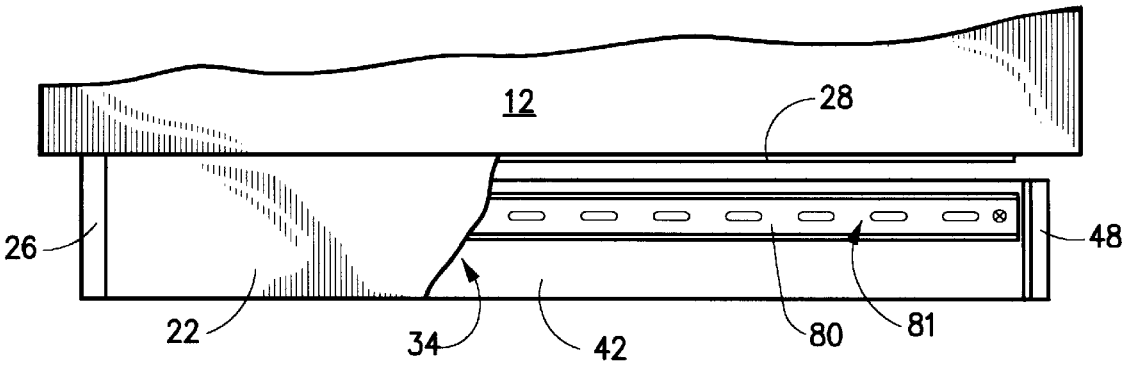
FIG. 3 is a side view in elevation, partially broken-away, showing the storage unit of FIGS. 1 and 2.
Figure 4:
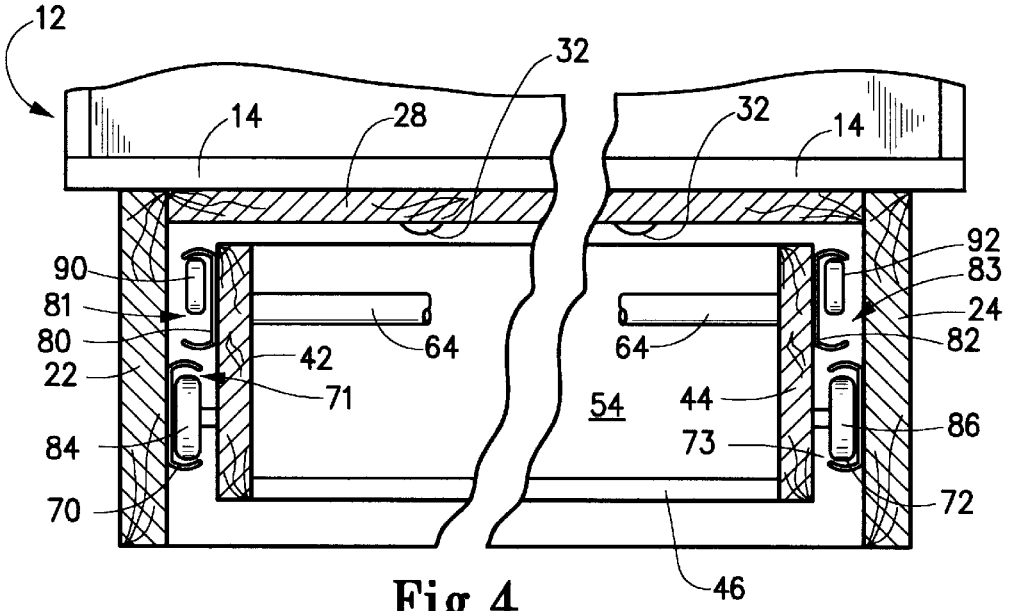
FIG. 4 is a front view in cross-section of the storage unit of FIGS. 1–3 attached to the underside of a support structure.
Figure 6:
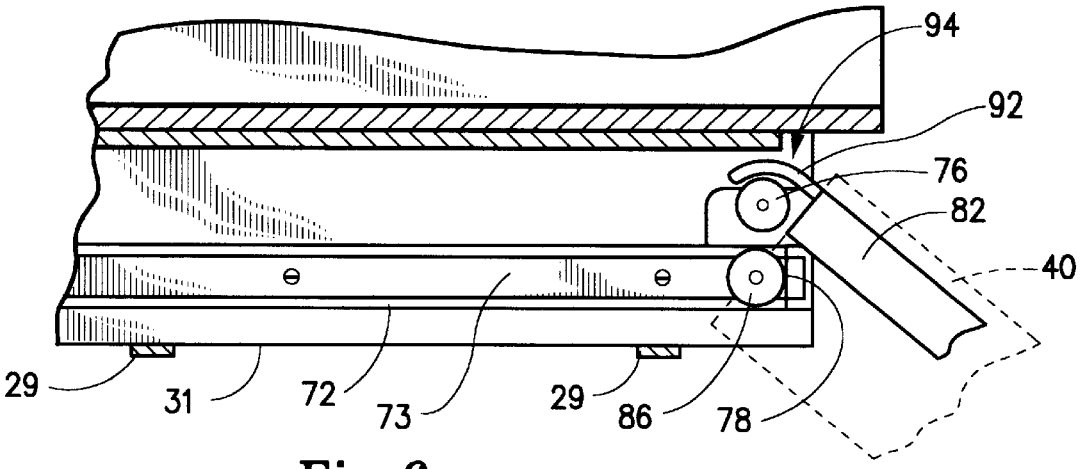
FIG. 6 is a side view in cross-section showing the front portion of the storage unit according to the exemplary embodiment with the pivotal motion of the drawer moving from an extended position to a pivotal position shown in phantom.

With reference to FIGS. 2, 3 and 6, it may be seen that storage unit 10 includes a frame 20 formed by a pair of spaced apart opposed frame end walls 22 and 24, a frame back wall 26 and a frame upper wall 28. Frame upper wall 28 is provided with a plurality of bores 30 which are adapted to receive screws 32, for example, to secure frame upper wall 28 to base wall 14. A pair of lower cross-members 29 secured to a lower edge 31 of frame 20. Frame 20 thus forms a storage region 34 located therein between frame end walls 22, frame end wall 24, frame back wall 26 and frame upper wall 28.

A drawer 40 is sized and adapted to fit in a storage state within storage region 34, although it should be understood that drawer 40 may be advanced out of the stored state to an extended state and thereafter into a pivoted state, as described more thoroughly below. While referring to this element as drawer 40, it should be understood that drawer 40 forms a combination drawer and shelf, also as described more thoroughly below.

In any event, drawer 40 includes a pair of parallel, spaced apart, opposed drawer end walls 42 and 44, a drawer bottom wall 46, a drawer front wall 48 and a drawer back wall 50. Drawer 40 thus has a rectangular configuration with end walls 42 and 44 being parallel to one another and with drawer bottom wall and drawer front wall being in parallel, spaced apart relation to one another extending between the drawer end walls 42, 44. Thus, drawer 40 has an upper drawer edge 52 that is opposite drawer bottom wall 46. Drawer 40 also includes a drawer interior wall 54 that is located medially between drawer front wall 48 and drawer back wall 50 in parallel relation thereto. Drawer interior wall 54 extends between drawer end walls 42, 44 to divide interior 56 of drawer 40 into a first compartment 58 and a second compartment 60. First and second compartments 58, 60 are adapted to receive items for storage, such as containers 62 for spices, seasonings and the like, as is shown in FIG. 1. In order to help retain containers 62 in compartments 58 and 60, a first bar 64 extends between drawer end walls 42, 44 at a location spaced between drawer interior wall 54 and drawer front wall 48 in spaced relation to drawer bottom wall 46 so as to be adjacent the drawer edge 52. A second bar 66 extends between drawer end walls 42, 44 at a location spaced between drawer interior wall 54 and drawer back wall 50 in space relation to drawer bottom wall 46 and adjacent to drawer edge 52.

Drawer 40 is slideably and pivotally mounted in frame 20. To this end, a stationary first rail assembly and a travelling second rail assembly are provided. As is best shown in FIGS. 2–5, the first stationary rail assembly includes a pair of first rails 70 and 72 that are immovably disposed on the support structure which, in this case, is frame end walls 22 and 24. First and second rails 70, 72 are in spaced apart, opposed relation to one another and thus further define storage region 34. First rails 70, 72 are parallel to one another with each respectively having a first channel 71, 73 that face one another across storage region 34. The first rail assembly also includes first wheels 74 and 76 respectively rotatably supported on each first rail 70 and 72 adjacent the forward ends 75, 77 thereof. A first limit stop 78 is located at a forward end of each of rails 70, 72, and second limit stop 79 is located at a rearward end of each rail 70, 72.

A travelling or second rail assembly is disposed on drawer 40. Specifically, the second rail assembly includes a pair of second rails 80 and 82 immovably disposed on opposite side portions of the drawer, such as drawer end walls 42 and 44, respectively. Second wheels 84 and 86 are located at a rearward end 85, 87 of second rails 80 and 82, respectively, with second wheels 84 and 86 being adapted to be received in a respective first channel 71, 73. In a manner similar to rails 70, 72, second rails 80, 82 each include a second channel 81, 83, respectively, which face opposite one another and thus face a respective first channel of first rails 70 and 72 when the drawer 40 is in the stored state. Each of first wheels 74 and 76 are then respectively received in second channels 81 and 83 so that drawer is movable from the stored state to an extended state wherein drawer 40 is advanced out of storage region 34. It should thus be appreciated that drawer 40 is thus supported by first and second rails 70, 72, 80, 82 and their associated wheels 74, 76, 84, 86 during this movement.

Figure 5:
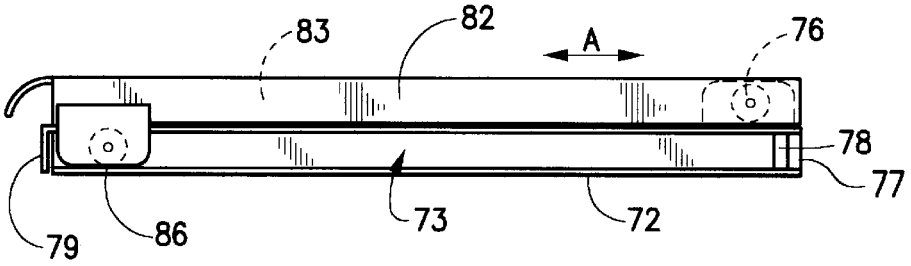
FIG. 5 is a side view in elevation showing a first and second rail for the first and second guide rail assemblies according to the exemplary embodiment of the present invention.

With reference now to FIGS. 2 and 5, it may be seen that a representative pair of first and second rails 72 and 82 are shown and mated with one another. Rails 72 and 82 are relatively movable with one another since wheels 76 and 86 roll in respective channels 83 and 73. Considering rail 72 to be stationary, then, it may be appreciated that rail 82 moves back and forth in the direction of arrow "A". Limit stop 78 is provided and is preferably formed out of a stiff, yet resilient material, such as a medium hard rubber, to cushion the impact of wheel 86 thereagainst. Likewise, limit stop 79 is provided and is again preferably formed out of a stiff, yet resilient rubber material to cushion the impact of wheel 86 when rail 82 is advanced rearwardly thereagainst. By mounting rail 72 to the end wall 24 of frame 20 and by mounting rail 82 to the drawer end wall 44, drawer 40 is completely supported throughout this sliding movement.

With reference now to FIGS. 2, 5 and 6, it may be seen that drawer 40 may be advanced from the stored state to an extended wherein wheels 84 and 86 abut their respective limit stops 78. At this point, drawer 40 may be pivoted from the extended state to the pivoted state shown in FIG. 1, and pivoted out of the pivoted state and back into the extended state so that it may be advanced again into the stored state. To facilitate this pivotal motion, each of second rails 80 and 82 are respectively provided with an arcuate guide finger 90 and 92 that pivots within a region, such as region 94 between a respective first wheel and frame upper wall 28. As may also be seen in FIG. 6, when drawer 40 is moved to the pivoted state, the first wheel 76 (and thus wheel 74) disengages from their respectively second channel 83 (and 81). Specifically, drawer 40 pivots on second wheels 84, 86 that are received in first channels 71 and 73.

Figure 7A:
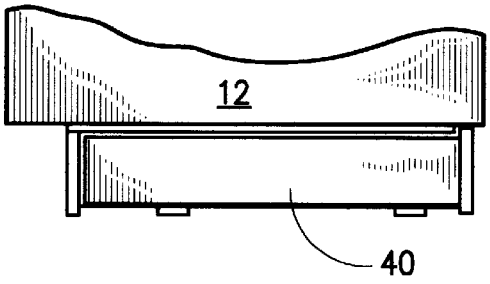
FIG. 7(*a*) is a diagrammatic side view in elevation showing the storage unit of the present invention attached to a support structure and in the stored position.
Figure 7C:
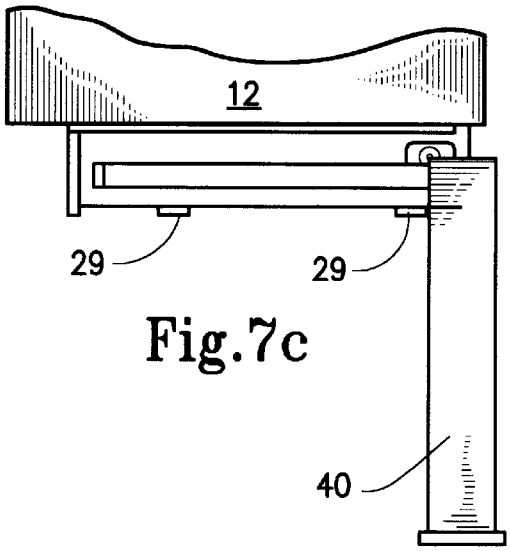
Figure 7B:
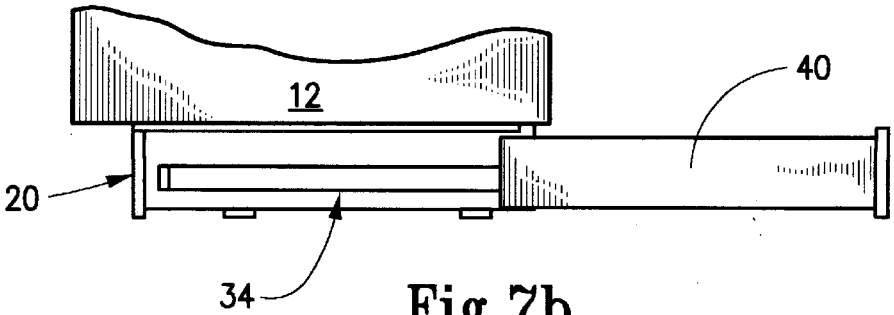

With reference now to FIGS. 7(*a*)–7(*c*), the various positions of drawer 40 are diagrammed with reference to cabinet 12. In FIG. 7(*a*), it may be seen that drawer 40 is oriented horizontally under the horizontal bottom surface of cabinet 12 in the stored state. In this position, the container received in compartments 58 and 60 are concealed and protected and completely surrounded relation in the interior 56 of drawer 40. However, drawer 40 may be advanced to the extended state shown in FIG. 7(*b*). In the extended state, drawer 40 is still in the horizontal position but is withdrawn from the storage region 34 of frame 20. At this point, the second wheels 84, 86 abut limit stop 78 so that drawer 40 may be pivoted about a pivot axle defined by the rotational axis of each of wheels 84 and 86 with wheels 84 and 86 being axially aligned for this purpose. Hence, as is shown in FIG. 7(*c*), drawer 40 can be pivoted to the pivoted state wherein preferably drawer 40 is in a perpendicular or vertical orientation with respect to the stored orientation shown in FIG.

7(*a*). This disengages each of wheels 74 and 76 from second channels 82 and 83, as discussed above. A forward one of cross-members 29 is located to act as a pivot limit stop both to prevent excess angular pivoting of drawer 40 past the perpendicular and to act as a support for a bottom portion of drawer 40 when it is in the pivoted state.

When drawer 40 is in the pivoted state, the containers 62 are in a position for easy access and use, but are retained within compartments 58 and 60 by means of first and second bars 64 and 66. Here, it should now be appreciated that drawer 40, when in the pivoted state, defines a shelf with the front and interior drawer walls 48 and 54 respectively forming horizontal bottom and middle shelf panels 48' and 54' with drawer bottom wall 46 forming a shelf back panel 46', as is shown in FIG. 1.

When use of the containers 62 is completed, they may be replaced in compartments 58 and 60, and drawer 40 may be pivoted from the pivoted state shown in FIG. 7(*c*) to the extended state shown in FIG. 7(*b*). Guide fingers 90 and 92 help assure the proper reengagement of wheels 74 and 76 in channels 81 and 83. At this point, drawer 40 may be moved from the extended state shown in FIG. 7(*b*) to the retracted state shown in FIG. 7(*a*). Limit stops 79 are provided to prevent and cushion the movement of drawer back into the stored position shown in FIG. 7(*a*). Moreover, as is seen in FIGS. 2 and 6, frame upper wall 28 has a reduced length in a direction of travel of drawer 40 so that drawer front wall 48 may nest in a flush relationship between the ends of frame end walls 22 and 24. Accordingly, the storage unit 10 provides a neat appearance when in the stored position yet a sturdy support structure giving access to container 62 when the in pivoted state.

A second exemplary embodiment of the present invention is shown in FIG. 8–12. Here, a pair of storage units 110 according to a second embodiment of the present invention is shown mounted and supported by a base wall 112 of a cabinet 114 which may be a standard kitchen or the like. Cabinet 114 includes a pair of sidewalls 116 along with base 112 as well as a cabinet back 117 and a door 118 that is operative to enclose an interior of cabinet 114. A shelf 119 is shown to extend parallel to base 112 so that storage units 110 are disposed between base 112 and shelf 119.

Each storage unit 110 includes a housing or frame 120 formed by a pair of spaced apart opposed frame end walls 122 and 124. Frame 120 has a frame back wall 126 and a frame upper wall 128. Frame 120 thus forms a storage region 134 located therein. A drawer 140 is sized and adapted to fit within storage region 134 so that it may be advanced out of the stored state and into an extended state as described above. Drawer 140 is constructed identically with drawer 40, discussed above.

Figure 8:
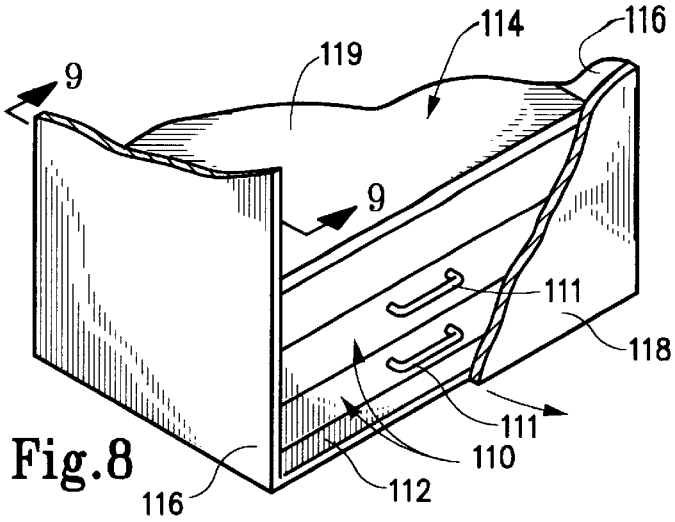
FIG. 8 is a perspective view of a pair of storage units according to a second exemplary embodiment of the present invention shown attached to the interior of a kitchen cabinet.
Figure 11:
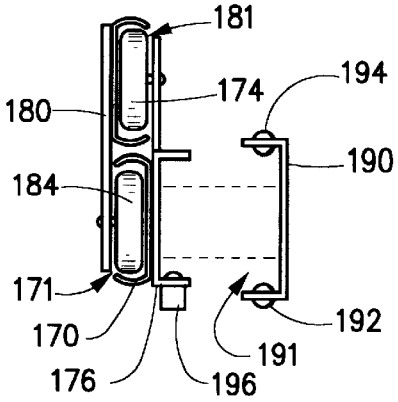
FIG. 11 is a cross-sectional view, partially exploded, of the rail support shown in FIG. 10.
Figure 12:
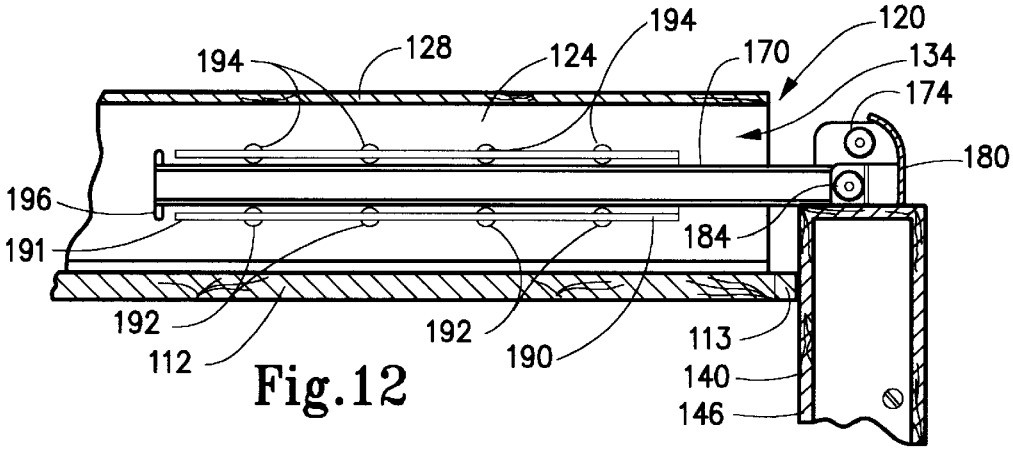
FIG. 12 is a side view, in partial cross-section, showing the second exemplary embodiment of the present invention in a pivoted state.
Figure 9:
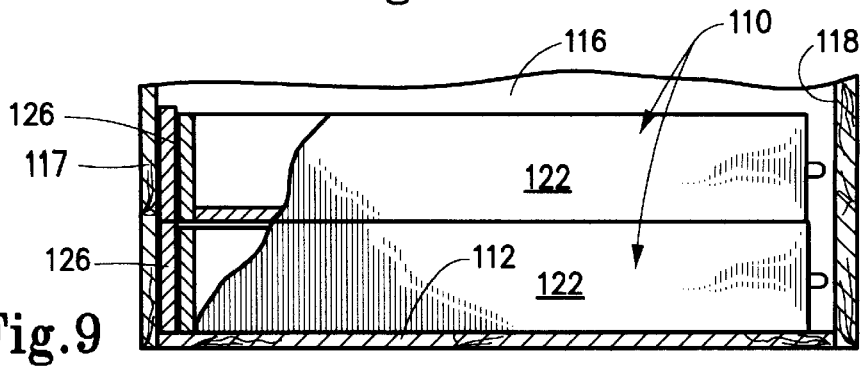
FIG. 9 is a cross-sectional view of the storage unit of FIG. 8, taken about lines 9—9 of FIG. 8.

It may be seen in reference to FIG. 8, 9 and 12, that each storage unit 110 must be inset with respect to base 112 so that door 118 may be moved into a closed position. This inset distance is also necessary to accommodate handles 111 on the front of each drawer 140. Accordingly, it is necessary that drawer 140 move out of storage region 134 an added distance to achieve the extended state before pivoting so that sufficient clearance is provided beyond the front edge 113 of base 112. To accomplish this, a modified version of the first and second rail assemblies is necessary. The modified rail assemblies are best shown in FIGS. 10–12.

Figure 10:
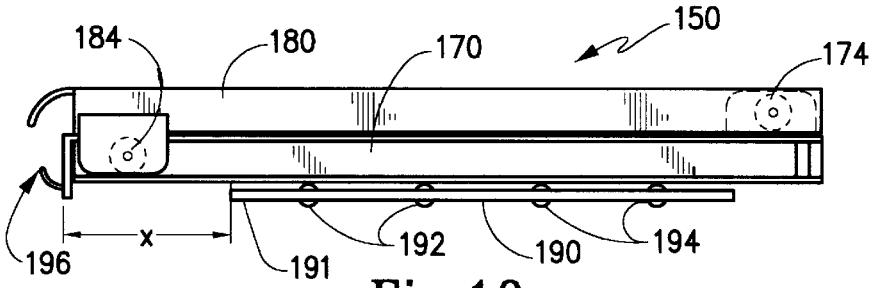
FIG. 10 is a side view in elevation showing the modified guide rails used in the second exemplary embodiment of the present invention.

A representative rail support 150 is shown in FIGS. 10–12. Here, a first rail 170 includes a first channel 171 that is adapted to receive a second wheel 184 that is rotatably journaled with respect to a second rail 180. Second rail 180 has a channel 181 that faces opposite channel 171 with channel 181 being adapted to receive a third wheel 174 disposed on first rail 170. This structure is substantially identical to that described above with the first exemplary embodiment. In these figures, however, it may be seen that rail 170 includes a channel piece 176 that is sized and adapted to fit within a channel 191 of a third rail 190 that is immovably mounted to a frame sidewall, such as sidewall 124.

Third rail 190 is provided with a plurality of opposed ball bearings 192 and 194. Thus, as is seen in FIGS. 10 and 12, first rail 170 is slidably supported by third rail 190 in the longitudinal direction from the stored state to the extended state. This throw distance "x" shown in FIG. 10, is selected to be sufficient to allow first rail 170 to translate a sufficient distance so that, in combination with the translation of second rail 180 with respect to first rail 170, drawer 140 extends outwardly a sufficient distance, as is shown in FIG. 12, so that it may then be pivoted to the orthogonal orientation without being prevented from doing so by edge 113 of base 112. Distance "x" is determined, in this exemplary embodiment, by the provision of an outer limit stop 196 which abuts edge 191 of third rail 190 thus preventing over extended travel of drawer 140 from the stored state to the extended state. An inner limit stop for this translation is provided by a back wall 126 of frame 120.

With reference to FIG. 12, it may be seen that, when limit stop 196 contacts 191 and when rail 180 moves sufficiently forward so as to be pivoted on wheel 184 to disengage wheel 174, drawer 140 may be moved into the pivoted position. Here, edge 113 provides a pivot limit stop to prevent angular rotation of drawer 140 past the perpendicular (vertical) orientation and moreover provide a drawer bottom wall 146. Thus, the pivot limit stop engages a bottom portion of drawer 140. Thus, it is desirable to dimension frame 120 so that, when mounted in a cabinet 114, edge 113 provides this limit stop. This limit stop is comparable, then, to the pivot limit stop provided by the forward one of cross-members 29 described with respect to the first exemplary embodiment. Naturally, other pivot limit stop constructions could readily be configured.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A storage unit adapted to mount to a support structure and operative to receive a plurality of items for selected storage and retrieval, comprising:

(a) frame pieces adapted for attachment to an underside of said support structure so that said frame pieces depend downwardly therefrom;

(b) a first rail assembly including a pair of first rails disposed on said frame pieces in spaced-apart, opposed relation to one another to define a storage region therebetween, each said first rails having a longitudinally extending first channel with said first channels facing one another, said first rail assembly including a first wheel rotatably supported on each said first rail and a first limit stop disposed on each said first rail;

(c) a drawer sized and adapted to be positioned underneath said support structure in the storage region between said first rails to define a stored state wherein said drawer has a stored orientation; and (d) a second rail assembly including a pair of second rails disposed on opposite side portions of said drawer and a second wheel rotatably supported on each said second rail, each second rail having a longitudinally extending second channel facing a respective first channel when said drawer is in the stored state, each of said first wheels received in a respective said second channel and each of said second wheels received in a respective said first channel so that said drawer is movable in a longitudinal direction from the stored state to an extended state wherein said drawer is advanced out of the storage region to a location wherein said second wheels each abut a respective first limit stop, said drawer when in the extended state being pivotable on said second wheels to move into a pivoted state wherein said drawer is in a perpendicular orientation with respect to the stored orientation such that each of said first wheels becomes disengaged from the respective said second channel, said first rails being disposed on said frame pieces immovably in the longitudinal direction and said second rails being disposed on said drawer immovably with respect thereto in the longitudinal direction.

2. A storage unit according to claim 1 including a longitudinally projecting, arcuate guide finger disposed on each of said second rails, said guide fingers positioned to guide engagement and disengagement of said first wheel and said second channel.

3. A storage unit according to claim 1 including a second limit stop on each of said first rails, said second wheels each abutting a respective second limit stop when said drawer is moved into the stored orientation.

4. A storage unit according to claim 1 wherein each said first limit stop is formed as a stiff, yet resilient cushion element.

5. A storage unit according to claim 1 wherein each said first limit stop encloses a respective end of a respective first channel thereby preventing a respective said second wheel from disengagement therewith such that said drawer is non-removably secured by said first and second rail assemblies.

6. A storage unit according to claim 5 wherein said first limit stops are each selectively removable such that each of said second wheels becomes disengageable from its respective channel such that said drawer may be removed from the storage region.

7. A storage unit according to claim 1 including a housing having a pair of opposed side walls and adapted to be affixed to the support structure, each said first rail being secured to a respective said sidewall such that said drawer is received in said housing when in the stored state.

8. A storage unit adapted to mount to a support structure and operative to receive a plurality of objects for selected storage and retrieval, comprising:

(a) a first guide rail assembly including a pair of first guide rails adapted for attachment to the support structure in spaced-apart, opposed relation to one another to define a storage region therebetween;

(b) a drawer sized and adapted to be positioned in the storage region between said first guide rails to define a stored state wherein said drawer has a stored orientation, said drawer having a bottom wall, a pair of spaced-apart opposed end walls, first and second spaced-apart opposed side walls extending between said end walls thereby defining an interior for said drawer, and an interior wall located between said side walls and extending between said end walls thereby dividing the interior into first and second compartments, said drawer including a first and second retaining bars extending between said end walls in spaced relation at respective selected distances from said bottom wall and to said interior wall on either side thereof; and (c) a second guide rail assembly including a pair of second guide rails disposed on opposite side portions of said drawer and a second wheel rotatably supported on each said second guide rail, said drawer being movable from the stored state to an extended state wherein said drawer is advanced out of the storage region, said drawer when in the extended state being pivotable to move into a pivoted state wherein said drawer is oriented obliquely with respect to the stored orientation such that said drawer becomes a shelf with said bottom wall defining a shelf back and with said first side wall and said interior wall defining shelf panels therefor, said retaining bars operative to retain items, said retaining bars affixed between said end wall such that the respective selected distances remain constant both in the stored state and in the pivoted state.

9. A storage unit according to claim 8 including frame pieces adapted for attachment to the support structure, each said first rail is mounted in an immovable relationship to said frame pieces.

10. A storage unit according to claim 8 wherein a pair of third rails mounted in a stationary relationship to the support structure, each said third rail slideably mounting a respective said first rail such that each said first rail is movable with respect to the support structure.

11. A storage unit according to claim 8 including a pivot limit stop positioned to prevent angular movement of said drawer beyond the perpendicular orientation and to support a bottom portion of said drawer when said drawer is in the pivoted state.

12. A storage unit adapted to mount to a horizontal support surface operative to receive a plurality of items for selected storage and retrieval, comprising:

(a) a frame having a pair of spaced-apart opposed frame end walls, a frame back wall and a frame upper wall forming a storage region therein;

(b) a drawer sized and adapted to fit in a stored state within the storage region, said drawer including a pair of parallel, spaced-apart, opposed drawer end walls, a drawer bottom wall, a drawer front wall and a drawer back wall extending between said drawer end walls parallel to one another thereby to define an interior for said drawer, said drawer having an upper drawer edge opposite said drawer bottom wall, said drawer including a drawer interior wall located medially between said drawer front wall and said drawer back wall in parallel relation thereto and extending between said drawer end walls to divide the interior into first and second compartments adapted to receive items for storage, a first bar extending between said drawer end walls at a location spaced between said drawer interior wall and said drawer front wall in spaced relation to said drawer bottom wall adjacent to the drawer edge and a second bar extending between said drawer end walls at a location spaced between said drawer interior wall and said drawer back wall in spaced relation to said drawer bottom wall adjacent to the drawer edge;

(c) a first rail assembly including a first rail immovably disposed on an interior side of each of said frame end walls in parallel, spaced-apart, opposed relation to one another, each said first rails having a first channel with said first channels opening and facing toward one another, said first rail assembly including a first wheel rotatably supported on each said first rail at a forward end thereof between its respective first rail and said upper frame wall and including a first limit stop disposed in each of the first channels proximate to the forward end of on each said first rail; and (d) a second rail assembly including a second rail disposed an outer surface of each of said drawer end walls and a second wheel rotatably supported on each said second rail proximate to said drawer back wall, each second rail having a second channel facing a respective first channel when said drawer is in the stored state, each of said first wheels received in a respective said second channel and each of said second wheels received in a respective said first channel so that said drawer is movable from the stored state to an intermediate extended state wherein said drawer is advanced out of the storage region to a location wherein said second wheels each abut a respective first limit stop, said drawer when in the extended state being pivotable on said second wheels to move into a pivoted state wherein said drawer is in a perpendicular orientation with respect to the stored orientation such that each of said first wheels becomes disengaged from the respective said second channel, said drawer when in the pivoted state defining a shelf with said front and interior drawer walls respectively forming horizontal bottom and middle shelf panels and with said drawer bottom wall forming a shelf back panel.

13. A storage unit according to claim 12 wherein each of said first rails is immovably affixed to a respective said frame end wall and wherein each of said second rails is immovably affixed to a respective said drawer end wall.

14. A storage unit according to claim 12 including a pivot limit stop positioned to prevent angular movement of said drawer beyond the perpendicular orientation and to support a bottom portion of said drawer when said drawer is in the pivoted state.

15. A storage unit adapted to mount to a support structure and operative to receive a plurality of items for selected storage and retrieval, comprising:

(a) a first rail assembly including a pair of first rails adapted for attachment to the support structure in spaced-apart, opposed relation to one another to define a storage region therebetween, each said first rails having a longitudinally extending first channel with said first channels facing one another, said first rail assembly including a first wheel rotatably supported on each said first rail and a first limit stop disposed on each said first rail;

(b) a drawer sized and adapted to be positioned in the storage region between said first rails to define a stored state wherein said drawer has a stored orientation; and (c) a second rail assembly including a pair of second rails disposed on opposite side portions of said drawer and a second wheel rotatably supported on each said second rail, each second rail having a longitudinally extending second channel facing a respective first channel when said drawer is in the stored state, each of said first wheels received in a respective said second channel and each of said second wheels received in a respective said first channel so that said drawer is movable from the stored state to an extended state wherein said drawer is advanced out of the storage region to a location wherein said second wheels each abut a respective first limit stop, said drawer when in the extended state being pivotable on said second wheels to move into a pivoted state wherein said drawer is in a perpendicular orientation with respect to the stored orientation such that each of said first wheels becomes disengaged from the respective said second channel, each said second rail including a longitudinally projecting arcuate guide finger, said guide fingers positioned to guide engagement and disengagement of said first wheel and said second channel during movement between the extended state and the pivoted state.

16. A storage unit adapted to mount to a support structure and operative to receive a plurality of items for selected storage and retrieval, comprising:

(a) a first rail assembly including a pair of first rails adapted for attachment to the support structure in spaced-apart, opposed relation to one another to define a storage region therebetween, each said first rails having a first channel with said first channels facing one another, said first rail assembly including a first wheel rotatably supported on each said first rail and a first limit stop disposed on each said first rail;

(b) a drawer sized and adapted to be positioned in the storage region between said first rails to define a stored state wherein said drawer has a stored orientation;

(c) a second rail assembly including a pair of second rails disposed on opposite side portions of said drawer and a second wheel rotatably supported on each said second rail, each second rail having a second channel facing a respective first channel when said drawer is in the stored state, each of said first wheels received in a respective said second channel and each of said second wheels received in a respective said first channel so that said drawer is movable from the stored state to an extended state wherein said drawer is advanced out of the storage region to a location wherein said second wheels each abut a respective first limit stop, said drawer when in the extended state being pivotable on said second wheels to move into a pivoted state wherein said drawer is in a perpendicular orientation with respect to the stored orientation such that each of said first wheels becomes disengaged from the respective said second channel; and (d) a pivot limit stop of a single-piece construction positioned to prevent angular movement of said drawer beyond the perpendicular orientation and to support a bottom portion of said drawer when said drawer is in the pivoted state.

* * * * *